US006718732B1

(12) United States Patent
Kovara et al.

(10) Patent No.: US 6,718,732 B1
(45) Date of Patent: Apr. 13, 2004

(54) CAPPING DEVICE AND METHOD TO APPLY OVERCAPS TO AEROSOL CANS

(75) Inventors: Daniel L. Kovara, County of Racine, WI (US); Steven B. Mineau, County of Racine, WI (US); Leon S. Samuelson, County of Racine, WI (US); Mark S. Wishau, County of Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 95 days.

(21) Appl. No.: 09/703,599

(22) Filed: Nov. 1, 2000

(51) Int. Cl.[7] ..... B67B 3/28

(52) U.S. Cl. ..... 53/313; 53/308; 53/329; 53/264

(58) Field of Search ..... 53/264, 313, 314, 53/315, 316, 308, 329, 306

(56) References Cited

U.S. PATENT DOCUMENTS

| | | | | | |
|---|---|---|---|---|---|
| 1,363,824 | A | | 12/1920 | Tait | |
| 2,117,041 | A | | 5/1938 | Simpson et al. | 226/89 |
| 2,433,549 | A | * | 12/1947 | Enkur et al. | 226/88.1 |
| 2,734,673 | A | * | 2/1956 | Hazel et al. | 226/88.1 |
| 3,121,984 | A | * | 2/1964 | Runco | 53/67 |
| 3,382,646 | A | * | 5/1968 | Leudtked et al. | 53/128 |
| 3,755,987 | A | * | 9/1973 | Dardaine et al. | 53/296 |
| 3,803,800 | A | | 4/1974 | Tavernier | 53/264 |
| 3,872,651 | A | | 3/1975 | Leonard | 53/319 |
| 3,879,921 | A | | 4/1975 | Leonard | 53/325 |
| 3,983,616 | A | | 10/1976 | Duke | 29/208 B |
| 4,098,058 | A | * | 7/1978 | Carrigan et al. | 141/238 |
| 4,434,885 | A | | 3/1984 | Brugman et al. | 198/388 |
| 4,523,377 | A | * | 6/1985 | Spletzer et al. | 29/773 |
| 4,663,913 | A | * | 5/1987 | Trendel | 53/314 |
| 4,691,501 | A | | 9/1987 | King | 53/485 |
| 4,932,824 | A | * | 6/1990 | Goslin | 193/27 |
| 5,050,369 | A | * | 9/1991 | Fiwek et al. | 53/471 |
| 5,070,599 | A | * | 12/1991 | Eitzinger et al. | 29/705 |
| 5,471,813 | A | | 12/1995 | Herzog | 53/128.1 |
| 5,649,645 | A | | 7/1997 | Demarest et al. | 222/153.07 |
| 5,842,321 | A | | 12/1998 | Jones | 53/281 |
| 5,937,616 | A | | 8/1999 | Ray | 53/201 |

* cited by examiner

*Primary Examiner*—John Sipos
*Assistant Examiner*—Louis Tran
(74) *Attorney, Agent, or Firm*—Marshall, Gerstein & Borun LLP

(57) ABSTRACT

A capping device and method for installing overcaps onto a plurality of aerosol cans moving on a manufacturing line is disclosed. The capping device has a pressure plate with a cap contact surface on one side and a bearing surface on an opposite side. The contact surface is oriented to face overcaps that are rested on a plurality of aerosol cans moving past the pressure plate on the manufacturing line. The contact surface is rotated about an axis so that an installation segment of the contact surface moves in concert with the plurality of aerosol cans. A pressure wheel has a rotatable circumferential surface arranged to bear against a part of the pressure plate to further bear the installation segment into contact with the overcaps of the plurality of aerosol cans. As the cans move past the pressure wheel and plate, the overcaps are installed on the aerosol cans by force applied via the installation segment of the contact surface that is moving along with the cans.

25 Claims, 6 Drawing Sheets

CAPPING DEVICE AND METHOD TO APPLY OVERCAPS TO AEROSOL CANS

FIELD OF THE INVENTION

The present invention relates generally to aerosol cans, and more particularly to a device and method for use in placing overcaps on aerosol cans moving along a manufacturing line.

BACKGROUND OF THE INVENTION

Like many products, aerosol cans are manufactured and assembled along continuous running assembly lines. When manufacturing aerosol cans, an overcap is installed on the top of each can to protect the spray components. Coordination of aerosol can and cap delivery along the assembly line can become complicated for even symmetrical can and cap configurations. Installation of the overcap onto the top of each can is often also quite complicated and difficult. Problems associated with overcap placement and installation are increased when overcaps are designed having tapered side walls, uneven top profiles, or other asymmetrical contours. It is difficult to apply uniform downward pressure on an asymmetrical overcap configuration using current manufacturing techniques.

One such technique that is known and utilized by the assignee of the present invention includes a rotating wheel having a circumferential surface with a plurality of depressions or recesses formed therein. The wheel is rotated on a horizontal axis and positioned above a plurality of vertically oriented aerosol cans traveling beneath the wheel. The recesses of the wheel each carry an overcap. The recesses and cans are coordinated so that one overcap is installed on each can. Pressure is applied by the rotating wheel to install the caps on the cans as the recess reaches the lower apex of the wheel above the can. When overcaps are designed having uneven, tapered or asymmetrical configurations, this pressure wheel technique requires that each overcap be properly oriented rotationally within its respective recess in order to evenly distribute pressure when installing the cap. Overcap orientation equipment and techniques are rather complicated and expensive to install and maintain.

U.S. Pat. Nos. 3,872,651 and 3,879,921 disclose overcap installation equipment for an aerosol can assembly line utilizing an overhead linear moving belt traveling above a conveyor belt carrying aerosol cans. The overhead belt is angled slightly downward to gradually move closer to the aerosol cans moving on the conveyor belt. A gradual downward force is applied by the overhead belt onto the overcaps resting on aerosol cans moving beneath the overhead belt. Fairly complex and numerous mechanical components are necessary to provide and operate the overhead belt that is used to seat the overcaps. Maintenance, installation, repair and overall component cost of such a construction are prohibitive.

There is a need for an improved overcap installation apparatus and method that can provide uniform downward pressure when installing overcaps, and particularly when installing asymmetrical, uneven or tapered wall configuration overcaps. Further, there is a need for an improved method and apparatus for installing overcaps that require no overcap rotational orientation regardless of the overcap configuration. There is also a need for a simpler, less expensive, more reliable, and more efficient overcap installation apparatus and method.

SUMMARY OF THE INVENTION

In accordance with the teachings of one example of the present invention, a capping device for installing overcaps onto a plurality of aerosol cans moving along a manufacturing line includes a pressure plate and a pressure wheel. The pressure plate has a cap contact surface on one side and a bearing surface on the opposite side. The contact surface is oriented to face overcaps resting on a plurality of aerosol cans moving past the pressure plate on the manufacturing line. The contact surface is rotatable about an axis so that an installation segment of the pressure wheel and contact surface moves in concert with the aerosol cans. The pressure wheel has a rotatable circumferential surface arranged to bear against part of the plate bearing surface to further bear the installation segment of the contact surface into contact with the overcaps of the plurality of aerosol cans.

In one example, the pressure wheel can be arranged to bear against a part of the plate bearing surface. In another example, the pressure plate can be a circular disc having a radially extending flange that defines a circular contact surface on one side and a circular bearing surface on its opposite side.

In a further example, a resilient support can be provided that supports and orients the pressure plate to an unbiased rotation plane generally perpendicular to the rotation axis. The resilient support permits the pressure plate to be reoriented to an offset rotation plane at an angle relative to the unbiased plane to bring the installation segment into abutment with the overcaps of the plurality of aerosol cans.

In yet another example, the pressure wheel can be constructed to hold the pressure plate in the offset rotation plane orientation as the plurality of aerosol cans move past the pressure wheel. In a still further example, an overcap infeed segment of the contact surface is spaced from the installation segment on the pressure plate and provides a cap infeed gap between the plurality of aerosol cans and the contact surface. The overcaps can be rested on each of the plurality of aerosol cans prior to reaching the installation segment.

In another example, the contact surface can be oriented at an angle relative to the rotation plane of the pressure plate so that the contact surface is generally perpendicular to the rotation axis when the pressure plate is in the offset rotation plane orientation. In a further example, the pressure plate can be a circular disc having a radially extending flange that defines a circular contact surface and wherein the flange is so angled relative to the rotation plane of the plate.

In another example, the pressure plate can be arranged to rotate about a generally vertical rotation axis. In still another example, the aerosol cans can be conveyed along a partial circular path beneath at least a portion of the contact surface of the pressure plate at a can velocity that essentially matches a rotation velocity of the pressure plate at a particular distance from the rotation axis.

In another example, a resilient support orients and supports a circular disc configuration pressure plate arranged to rotate about a vertical axis. The support has a plurality of vertically oriented pins extending from a rotary shaft hub, each pin having an upper pin shoulder that limits vertical travel of the disc and a spring that bears against a portion of the disc and biases the disc upward into contact with the shoulder. In a further example, the capping device can have a star wheel assembly arranged to rotate concentrically with the shaft hub and the rotary disc. The star wheel assembly can have a plurality of can receiving recesses in a circumferential surface adapted for guiding the aerosol cans along a path beneath at least part of the contact surface of the disc.

In one example according to the teachings of the present invention, a capping station is provided for installing an overcap on each of a plurality of aerosol cans moving along a manufacturing line. The capping station includes an aerosol can infeed conveyor that moves a plurality of aerosol cans to the station. An overcap infeed is adapted to initially rest an overcap on each of the aerosol cans that enter the station to produce a plurality of can pre-assemblies. The capping station also includes a pressure plate with a cap contact surface on one side and a bearing surface on the opposite side. The contact surface is oriented to face the overcaps of the can pre-assemblies moving past the pressure plate through the station. The contact surface is rotatable about an axis so that an installation segment of the contact surface moves in concert with the can pre-assemblies. The pressure wheel has a rotatable circumferential surface arranged to bear against a part of the pressure plate to further bear the installation segment against the overcaps of the can pre-assemblies. In various examples, the pressure plate and pressure wheel can have characteristics discussed above for the capping device.

In another example, a transfer wheel assembly can be arranged concentric and affixed for co-rotation with the pressure plate. The transfer wheel assembly can have at least one transfer star wheel with a plurality of can receiving recesses in a circumferential surface that are adapted for guiding the aerosol cans along the path.

In a further example, an infeed wheel assembly can be arranged to rotate about a second axis parallel to the rotation axis. The infeed wheel assembly can have at least one infeed star wheel with a plurality of can receiving recesses in a circumferential surface that are adapted for receiving aerosol cans from the infeed conveyor and delivering the aerosol cans to the transfer wheel assembly prior to reaching the installation segment of the pressure plate. In yet another example, a cap outlet of the overcap infeed is positioned between the infeed wheel assembly and the transfer wheel assembly.

In another example, a discharge wheel assembly can be arranged to rotate about a third axis parallel to the rotation axis, the discharge wheel assembly can have at least one discharge star wheel with a plurality of can receiving recesses in a circumferential surface that are adapted for receiving aerosol cans with installed overcaps from the transfer wheel assembly and delivering the aerosol cans to the discharge conveyor.

In one example according to the teachings of the present invention, a method of applying overcaps to aerosol cans moving along a manufacturing line is provided. The method includes providing a capping station on the manufacturing line. The capping station has a conveyor surface, a pressure plate and a pressure wheel. The pressure plate is rotatable about an axis and has a cap contact surface and a bearing surface and the pressure wheel having a rotatable circumferential surface. The circumferential surface of the pressure wheel is positioned to bear against a part of the pressure plate so that an installation segment of the contact surface is positioned nearer the conveyor surface. A plurality of the aerosol cans are delivered from an infeed conveyor to the capping station. An overcap is rested on each of the plurality of aerosol cans to form a plurality of can pre-assemblies. The can pre-assemblies are conveyed between the conveying surface and the installation segment of the plate contact surface while moving the can pre-assemblies through at least part of the capping station to install the overcaps on the can pre-assemblies. The aerosol cans with installed overcaps are then discharged from the capping station.

In another example, the method can include providing a circular disc pressure plate and arranging the disc to rotate about a generally vertical axis. In a further example, the method can include providing the pressure plate with a radially extending flange defining the contact surface. In a still further example, the method can also include rotating the pressure plate flange about the axis and moving the can pre-assemblies along a path at least a part of which is concentric with the pressure plate and beneath the contact surface. In yet another example, the method also can include rotating the flange and moving the can pre-assemblies at essentially the same speed over at least the part of the path beneath the contact surface.

In another example, the method can include resiliently supporting the pressure plate such that an unbiased rotation plane of the pressure plate is oriented generally perpendicular to the rotation axis. The pressure plate can be offset so that the rotation plane of the pressure plate is oriented at an angle relative to the unbiased rotation plane such that the installation segment is nearer the conveying surface. In a further example, the step of delivering can include conveying each aerosol can to an infeed segment of the pressure plate that is spaced from the installation segment. The step of resting can further include resting an overcap on each aerosol can disposed beneath the contact surface at the infeed segment. In still another example, the step of providing also can include providing a circular disc pressure plate having a radially extending flange defining the contact surface oriented at an angle relative to the rotation plane of the disc such that the contact surface is arranged perpendicular to the rotation axis when the disc is in the offset rotation plane orientation.

Other aspects and advantages of the present invention will become apparent upon consideration of the following detailed description.

DETAILED DESCRIPTION OF THE PREFERRED EMBODIMENTS

Figure 1:
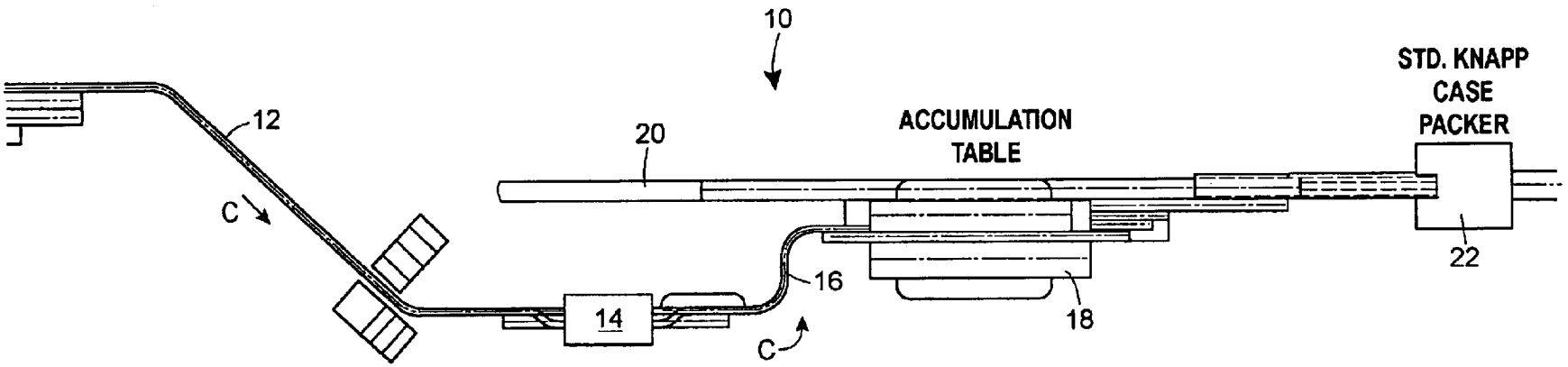
FIG. 1 is an elevation of a portion of a manufacturing line for aerosol cans including a capping station constructed according to the teachings of the present invention.

Referring now to the drawings, FIG. 1 shows a top view of a portion of an aerosol can manufacturing line 10. The line 10 has an infeed conveyor 12 moving in the direction of the arrows C for conveying a plurality of aerosol cans. The infeed conveyor 12 delivers filled and assembled aerosol cans to a capping station 14 constructed according to the teachings of the invention. A discharge conveyor 16 moves the cans beyond the capping station in the direction of the arrows C to a conventional accumulation table 18 where groups or slugs of aerosol cans are accumulated for packaging. For example, a box conveyor 20 can be positioned adjacent the discharge conveyor 16 providing a plurality of containers into which the assembled aerosol cans are packaged at a case packing station 22. As is known in the art, the packaged product is then conveyed further downstream and eventually loaded on appropriate transportation for delivery to various destinations.

Figure 2:
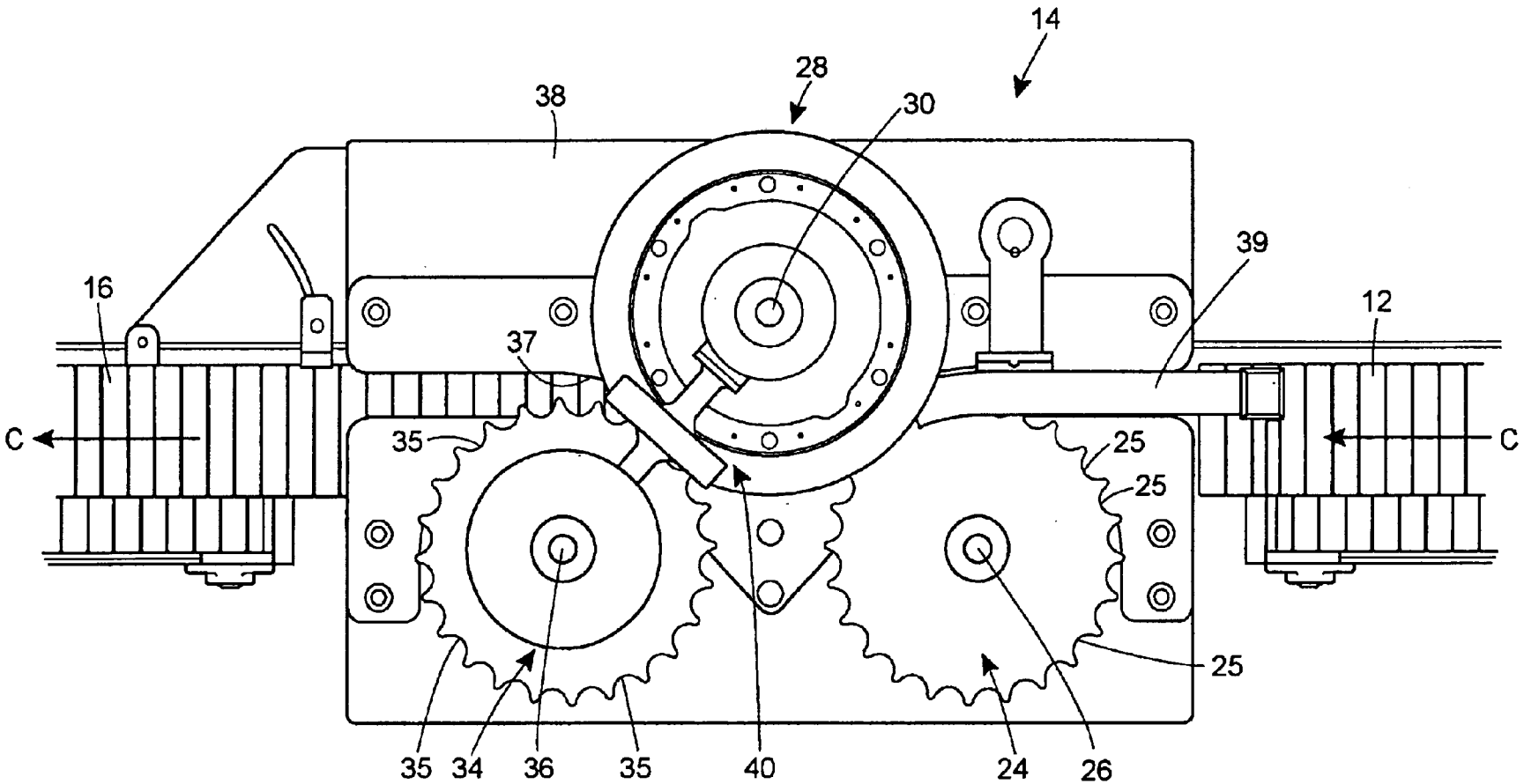
FIG. 2 is a plan view of one example of a capping station as shown in FIG. 1 and constructed according to the teachings of the present invention.
Figure 3:
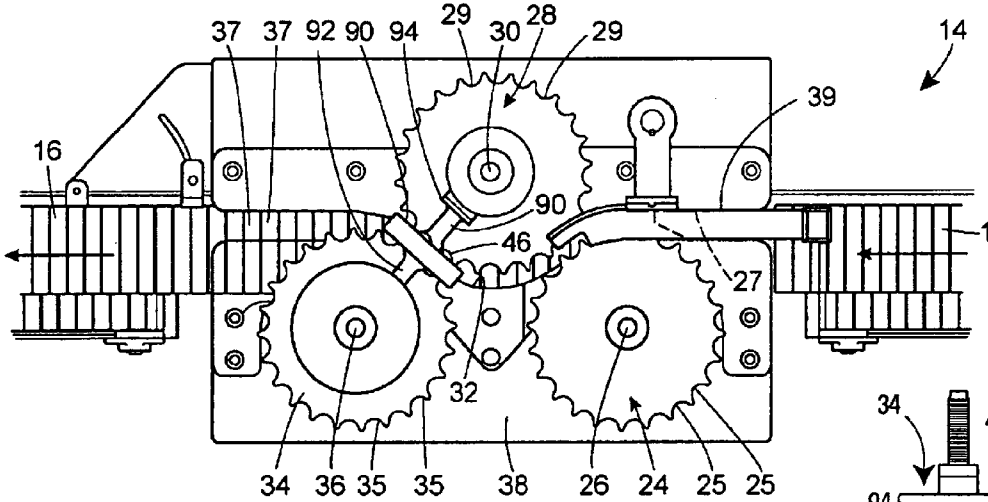
FIG. 3 is a plan view of the capping station shown in FIG. 2 wherein a portion of a capping device has been removed to show a path of travel for aerosol cans through the station.
Figure 4:
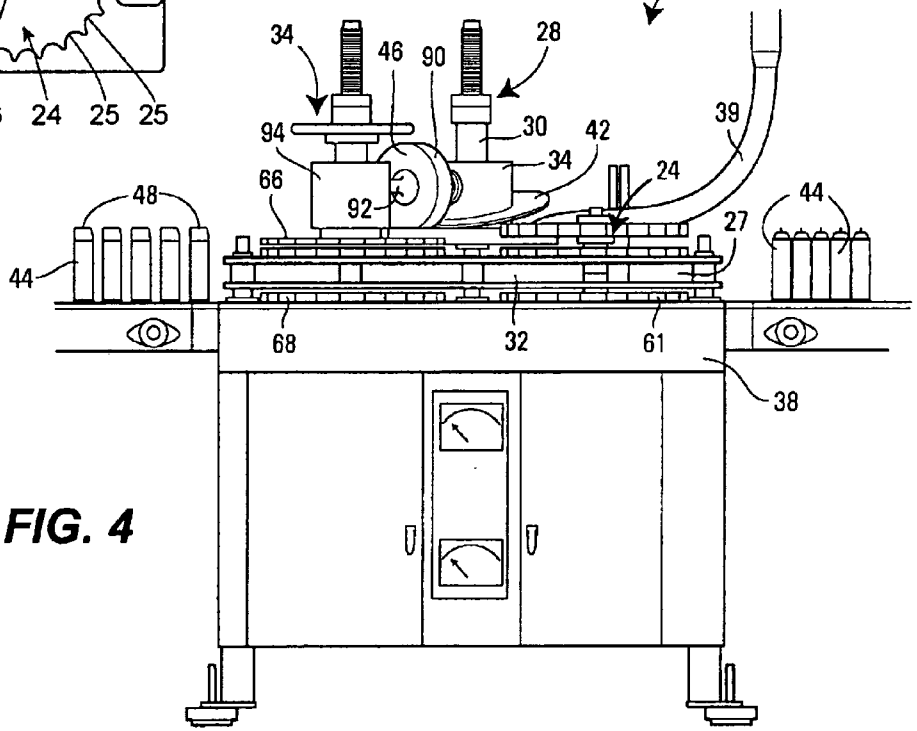
FIG. 4 is a front view of the capping station shown in FIG. 2.

FIGS. 2–4 show top and front views of the capping station 14 in greater detail. In general, the capping station 14 has an infeed wheel assembly 24 with a plurality of recesses 25 formed in its circumferential surface. The recesses are contoured to generally fit the of the aerosol cans. The infeed wheel assembly 24 in this example is supported on a vertically oriented rotary shaft 26 and rotates about the shaft. The recesses 25 cooperate with one or more guide rails 27 positioned adjacent but spaced from the infeed wheel assembly 24 to urge aerosol cans from the infeed conveyor 12 into the capping station 14.

A transfer wheel assembly 28 (better shown in FIG. 3 where a pressure plate portion of the assembly has been removed) is positioned adjacent and down stream of the infeed wheel assembly 24. The transfer wheel assembly 28 also has a plurality of contoured recesses 29 in its exterior circumferential surface. The recesses 29 cooperate with the recesses 25 of the infeed wheel assembly 24 and receive aerosol cans delivered from the infeed wheel assembly. The transfer wheel assembly 28 also rotates about a vertically oriented shaft 30 in this example. One or more guide rails 32 cooperate with the recesses 29 of the transfer wheel assembly 28 to further urge aerosol cans through the capping station 14. As is described in greater detail below, the transfer wheel assembly 28 incorporates part of the capping device according to the teachings of the invention.

A discharge wheel assembly 34 is disposed downstream of the transfer wheel assembly 28. The discharge wheel assembly also includes a plurality of contoured recesses 35 in its exterior circumferential surface. The recesses 35 cooperate with the transfer wheel recesses 29 and receives aerosol cans delivered from the transfer wheel assembly. The discharge wheel assembly 34 also is mounted for rotation about a vertical shaft 36. One or more guide rails 37 cooperate with the discharge wheel recesses 35 to urge aerosol cans through the remaining portion of the capping station and onto the discharge conveyor 16.

The general construction of the infeed, transfer, and discharge wheel assemblies is known in the art of aerosol can manufacturing. These components are typically mounted on a table 38 cooperating with the infeed conveyor 12 and discharge conveyor 16. A cap infeed guide 39 is mounted adjacent the capping station for delivering, one at a time, overcaps that are to be installed on aerosol cans moving along the manufacturing line 10. The overcaps are delivered from a mezzanine or reservoir of overcaps (not shown) via the infeed guide 39 as is known in the art.

Figure 5:
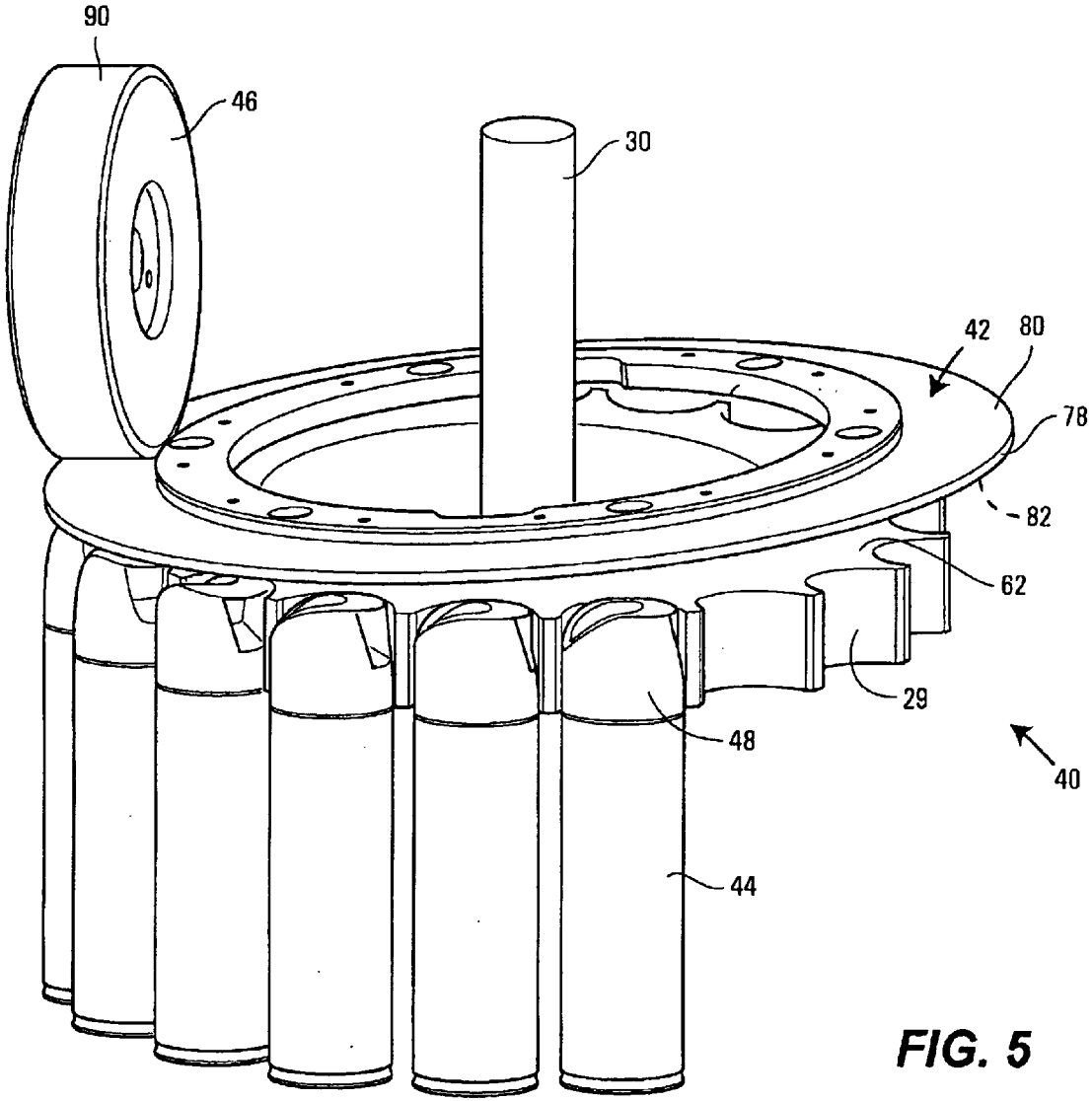
FIG. 5 is a perspective view of certain capping device components of the capping station shown in FIG. 2.
Figure 6:
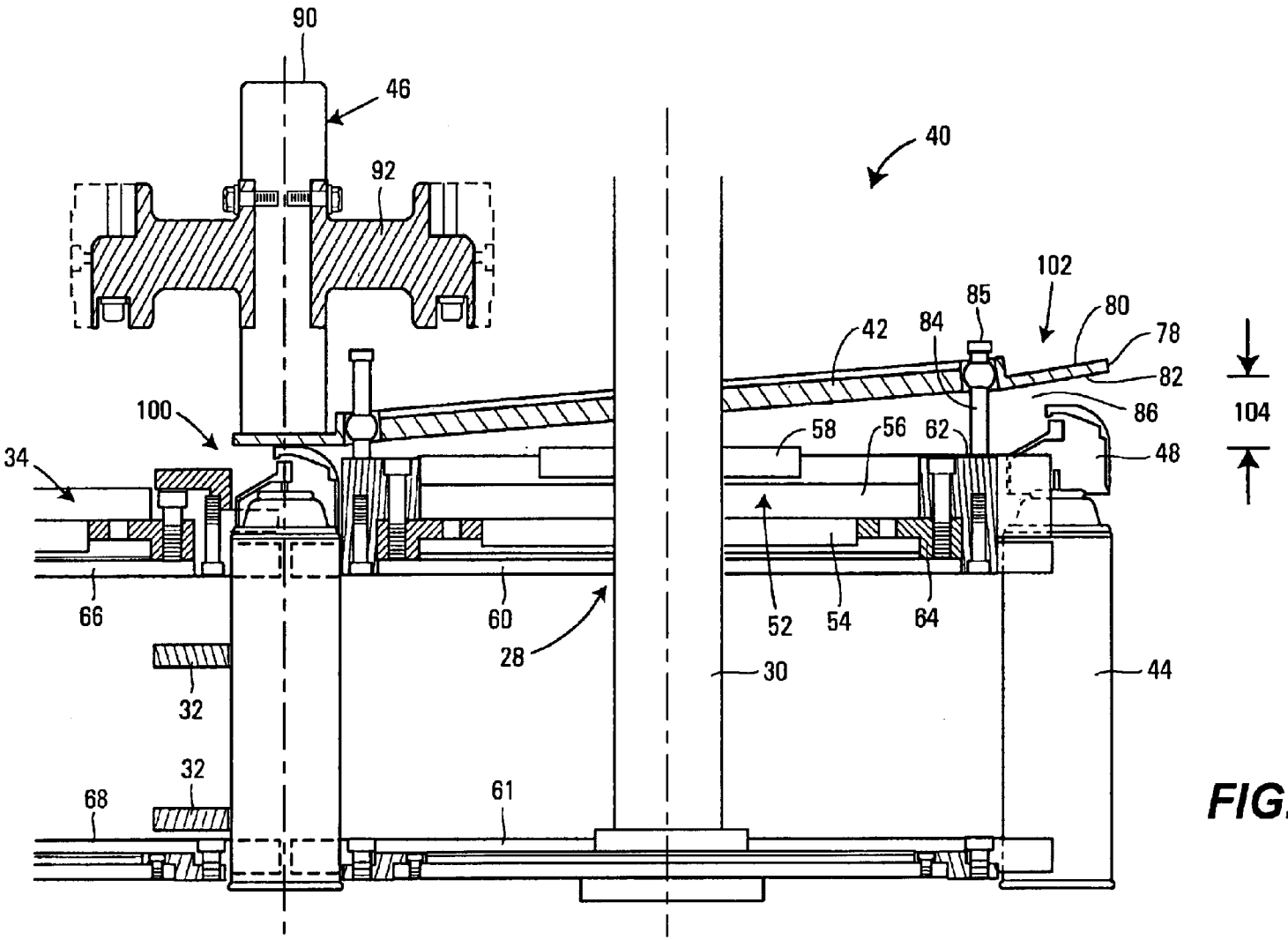
FIG. 6 is a cross section taken along line VI—VI of the capping device portion of the capping station shown in FIG. 4.

FIG. 5 illustrates a perspective view of the various components that generally cooperate to provide a capping device 40 constructed according to the teachings of the present invention. FIG. 6 illustrates a cross section of the capping device components disclosed in this example and taken from FIG. 4.

The capping device 40 in general has a pressure plate 42 disposed over a plurality of aerosol cans 44 moving along the conveyor 12 through the capping station 14. The capping device 40 also has a pressure wheel 46 positioned adjacent a portion of the pressure plate for bearing a portion of the pressure plate against overcaps 48 positioned on the aerosol cans 44. As is known in the art, an overcap requires a given amount of force to be completely installed on an aerosol can so that the over cap is retained securely on the can until reaching a consumer. The pressure wheel 46 applies a gradual, evenly distributed and predetermined amount of force via the pressure plate 42 to the overcaps 48. The amount of necessary force or pressure depends upon the particular overcap and aerosol can configuration and construction.

As best illustrated in FIGS. 2 and 6, a mandrel or hub assembly 52 is affixed to and rotates with the vertical shaft 30 of the transfer wheel 28. The mandrel 52 has several different diameter hub sections 54, 56 and 58 each adapted for securing one or more different components of the transfer wheel assembly for rotation with the shaft.

The transfer wheel assembly 28 has a pair of can star wheels 60 and 61 received concentrically over the shaft 30. In the present example, the upper can star wheel 60 is affixed by conventional fasteners to a cap star wheel 62 which is also concentric with the shaft 50. A cylindrical mounting plate 64 is concentrically received over a first hub section 54 for aligning the mounting plate and is bolted to a second hub section 56. The cap star wheel 62 in this example is bolted to the mounting plate 64. In this manner, the cap star wheel 62 and the upper can star wheel 60 are each secured to each other and to the mandrel 52 for co-rotation with the shaft 30. The lower can star wheel 61 is also mounted at the lower end of the shaft 30 for concentric rotation with the shaft.

In order to retain the aerosol cans in a vertical orientation during movement through the capping station 24, the upper star wheel 61 is positioned for contacting aerosol cans near the top end and the lower star wheel 66 is positioned for contacting the aerosol cans near the bottom ends. The two star wheels 60 and 61 in combination retain the aerosol cans vertically oriented.

As will be evident to those skilled in the art, numerous other constructions and arrangements can be utilized for securing the various components including the infeed stars 60, 61 and 62 to the shaft 30 for rotation therewith. The present example is only one of many possible embodiments. Also, each of the infeed wheel assembly and the discharge wheel assembly can include an upper and a lower star wheel similar to and mirroring the can star wheels 60 and 61. For example, FIG. 6 shows a portion of upper and lower star wheels 66 and 68 that mirror the can star wheels 60 and 61.

The star wheels 60, 61 and 62 each have a plurality of the recesses 29 that are configured to follow an exterior contour of the aerosol cans 44 or the caps 48. During operation, each star wheel recess 29 guides an aerosol can through the circuitous path of the capping station 14. The recesses in each of the star wheels are vertically aligned with corresponding recesses in each other star wheel of the transfer wheel assembly to retain the cans and caps in proper alignment.

Figure 7:
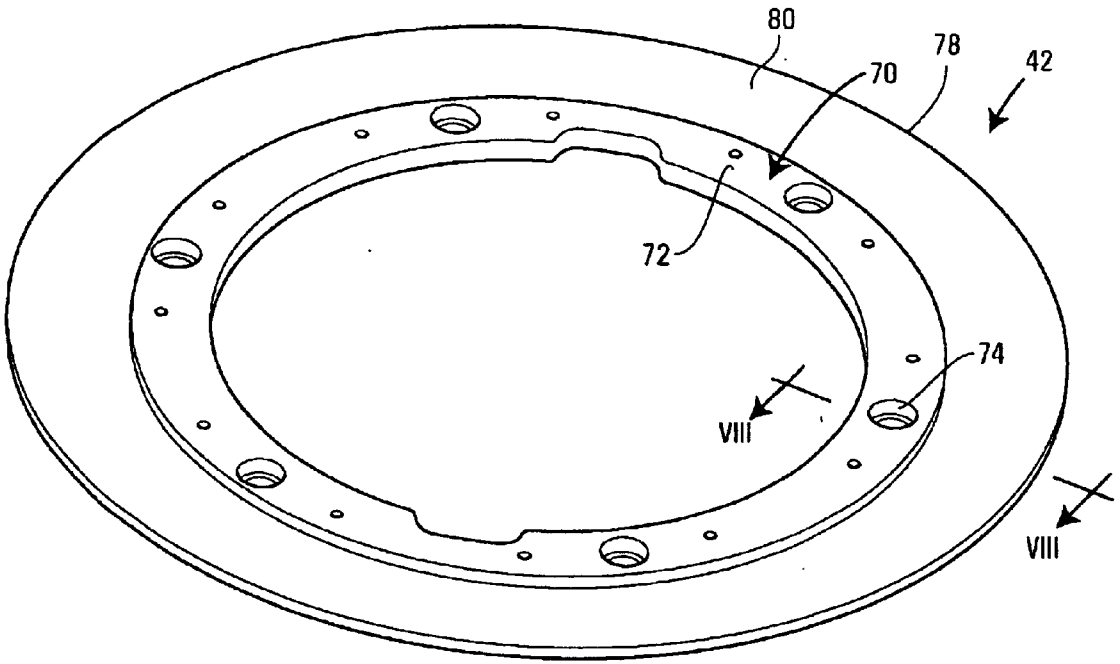
FIG. 7 is a perspective view of one example of a pressure plate constructed according to the teachings of the present invention.
Figure 8:
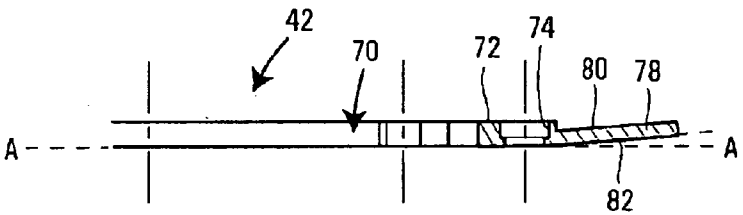
FIG. 8 is a cross section taken along line VIII—VIII through a portion of the pressure plate shown in FIG. 7.

As best shown in FIGS. 6–8, the pressure plate 42 in the present example is a circular ring or disc that is also concentrically positioned over the shaft 30. The disc 42 is secured , as described below, to a portion of the transfer wheel assembly 28 so that the pressure plate rotates in concert with the shaft 30 and star wheels 60, 61 and 62. As will be evident to those of ordinary skill in the art, the pressure plate need not be circular, round, symmetrical, or the like in order to perform its attendant functions. The pressure plate shape and configuration can vary considerably and yet fall within the scope of the invention.

As shown in FIG. 5, the pressure plate or disc 42 has an interior diameter and an exterior diameter that define an annular material body 70. A first radially inner portion 72 of the body 70 has a plurality of mounting openings 74 formed through the material. A second portion of the body 70 is positioned radially outward from the first portion 72 and defines a circumferential, radially extending flange 78. FIG. 8 is a cross section of a portion of the pressure plate or disc 42 including the first portion 72 and second the flange 78. As shown in FIG. 8, the flange 78 has an upper or bearing surface 80 that, when installed, faces the pressure wheel 46 in the present example. The flange also has a bottom or can contact surface 82 that generally faces the aerosol cans 42 when installed in the capping station 14.

Each of the openings 74 of the first body portion 72 is used to resiliently mount the disc 42 to the mandrel 52. A plurality of upstanding pins 84 are suitably secured to part of the mandrel, in this example to the mounting plate 64 attached to the mandrel, and terminate at a pin shoulder 85 at its top surface for bearing against the pressure plate 42 to retain the plate on the pins. Each pin 84 has a resilient spring 86 sandwiched between the mounting plate 64 and the pressure plate 42. The pressure plate is biased upward into contact with the shoulders 85 by the springs 86. The pressure plate is retained in an unbiased rotation plane orientation that is generally perpendicular to the rotation axis of the shaft 30 by the springs 86, without other forces applied. However, the resilient support including the pins 84 and the springs 86 permit one or more segments of the disc or pressure plate 42 to be biased downward by overcoming the spring force of the appropriate springs. The purpose and function of this resilient support is described in greater detail below.

The pressure wheel 46 in the present example has a generally smooth exterior circumferential surface 90. The width of the surface 90 in this example generally corresponds to that of the bearing surface 80 of the disc or pressure plate flange 78. The circumferential surface 90 of the wheel bears against the bearing surface 80 of the pressure plate which in turn biases an installation segment 100 of the plate contact surface 82 downward as it rotates in-conjunction with the transfer wheel assembly 28. As discussed in greater detail below, the installation segment 100 of the contact surface 82 is thus borne into contact with overcaps 48 resting on aerosol cans 44 passing beneath the pressure wheel 46.

As is known in the art, the pressure wheel 46 is supported on a shaft 92 which is coupled through one or more gear reducers or transmissions 94 directly to the vertical shaft 30 and/or to the other vertical shafts 26 and 36 of the capping station 14. In this manner, rotation of the appropriate vertical shaft or shafts also rotates the pressure wheel 46. The transmission is geared to rotate the pressure wheel 46 at a speed that corresponds to that of the pressure plate 42 and hence, the transfer wheel assembly 28. In one example, a single motor (not shown) can be used to drive each of the vertically rotating wheel assemblies 24, 28, 34 and the horizontally rotating pressure wheel 46 through cooperating gearing.

As shown in FIGS. 1 and 4, the aerosol cans 44 during operation of the manufacturing line 10 proceed along the infeed conveyor 12 toward the capping station 14. Each of the aerosol cans 44 is initially picked up by the infeed wheel assembly 24, one can within each recess 25 of the star wheels. The recesses 25 and guide rails 27 guide the aerosol cans to an infeed segment 102 of the transfer wheel assembly 28. Each of the aerosol cans 44 is picked up by one of the recesses 29 in the can star wheels 60, 61 and 62 of the transfer wheel assembly 28. The plurality of cans 44 are urged by the guide rails 32 and recesses 29 through a portion of a circular path from the infeed segment 102 to the installation segment 100 beneath the pressure wheel. The right hand side of the capping device section shown in FIG. 6 represents the infeed segment 102 and the left hand side represents the installation segment 100.

A plurality of the overcaps 48 are delivered by the cap infeed guide 39 from the mezzanine (not shown). As will become apparent below, the position of the infeed guide 39 can coincide with the infeed segment 102 or can be between the infeed and installation segments. The overcaps 48 are placed one by one on each of the aerosol cans 44 moving through the infeed segment 102. As described below, the caps 48 can be rested on the cans 44 directly beneath contact surface at the infeed segment at the same time that caps are installed on the cans at the installation segment.

The pressure plate 42 is oriented in an offset rotation plane, as shown in FIGS. 5 and 6 as permitted by the resilient support. The offset orientation plane is at an angle relative to the unbiased rotation plane of the plate and the rotation plane of the transfer wheel assembly 28. However, the plate still rotates about the vertical axis. This is because the pressure wheel position and location are fixed while the pressure plate rotates beneath the wheel. The offset plane of rotation of the plate does not change because the resilient supports permit the part of the pressure plate beneath the pressure wheel at any given moment to always be biased downward. The end of the pressure plate 42 that is positioned opposite the pressure wheel 46 is biased the furthest upward toward the pin shoulders 85 by the springs 86.

A gap 104 is created between the contact surface 82 of the pressure plate 42 and the top of the aerosol cans 44 positioned beneath the contact surface. The gap is greatest at the end opposite the pressure wheel and is smallest at the installation segment, which is directly beneath the pressure wheel in this example. The gap 104 gradually decreases moving toward the installation segment. The gap 104 permits overcaps 48 to be placed on aerosol cans beneath the contact surface 82 at the infeed segment 102 spaced from the installation segment of the pressure plate 42. The infeed segment 102 can be virtually anywhere on the circumference of the pressure plate that provides a sufficient gap 104 to insert overcaps and place them on aerosol cans.

The infeed segment 102 of the pressure plate can be located 180° opposite the installation segment 100 and hence, the pressure wheel 46, providing the largest possible gap 104. Alternatively, the infeed segment can be located less than 180° around the pressure plate 42 from the pressure wheel 46, as shown in the present example, as long the gap 104 at the particular location is sufficient to place the caps 48 on the cans 44. The offset rotation plane orientation angle of the pressure plate, the diameter of the pressure plate, the size of the caps, and the size of the cans, among other variables, will determine a permissible location for the cap infeed segment of the pressure plate. If the infeed segment location varies from that shown in the described example, the incoming angle (as viewed from above as in FIG. 1) of the infeed conveyor 12 or the length of travel around the infeed wheel 24 can be varied to properly deliver the cans 44 to the infeed segment.

In one example shown in FIGS. 6, 7 and 8 and constructed according to the teachings of the invention, the flange 78 of the disc body 70 is provided at an angle relative to the plane A of the body, and hence, relative to the rotation plane of the pressure plate 42. The degree of the angle between the flange 78 and the rotation plane A of the inner body portion 72 will depend on the above mentioned cap, aerosol can, and pressure plate size characteristics. This angle can assist in achieving the desired gap 104 at a particular infeed segment location. This angle, more importantly, can permit the flange 78 at the installation segment 100 to be essentially parallel to the tops of the aerosol cans and caps passing beneath the pressure wheel, even though the pressure plate is oriented in the offset rotation plane. In one example, the flange angle is about 4° degrees, and in a further example, the offset rotation plane angle is also 4°. The angled flange 78 further permits the pressure wheel circumferential surface 90 to be arranged essentially parallel to the bearing surface 80 of the pressure plate when in the offset rotation plane as shown. These conditions provide uniform load distribution from the pressure wheel to the pressure plate and from the pressure plate to the overcaps, resulting in an efficient overcap seating apparatus and method.

To seat the overcaps on the aerosol cans delivered from the infeed wheel assembly 24, the shaft 30 rotates the can star wheels 60 and 61 and rotates the cap star wheel 62 of the transfer wheel assembly 28, moving the cans toward or directly into the infeed segment 102. An overcap 48 is rested on each can 44 by the infeed guide 39 at the infeed segment 102 producing a plurality of can pre-assemblies. As the pre-assembled aerosol cans 44 move gradually toward the installation segment 100, the pressure plate 42 closes in on the overcaps 48 until the contact surface 82 comes into contact with the overcaps near the installation segment. As the aerosol cans 44 move further toward the pressure wheel 46 as shown in FIG. 3, the overcaps 48 are pressed downward by the contact surface 82 and are installed on the aerosol cans. The gradual application of force and the parallel contact surface 82 evenly and efficiently presses the caps on the cans.

Once the overcaps 48 are installed, the aerosol cans 44 continue to move along with the recesses 29 of the transfer wheel assembly 28 until being transferred to the recesses 35 of the discharge wheel assembly 34. The cans are then discharged onto the discharge conveyor 16. The cans with installed overcaps are then delivered downstream in the manufacturing line, such as to an accumulation table 18 for further packaging and shipping.

The capping station 14 continually permits overcaps 48 to enter at the infeed segment 102 and simultaneously be installed at the installation segment 100. The simplicity of the component arrangement and the significantly reduced number of parts provides for a much more efficient, less expensive and reliable capping device, capping station and capping method. As will be apparent to those of ordinary skill in the art, the rotation axis angles, flange angle, rotation plane angles, and component arrangement can vary considerably from the disclosed exemplary device.

Numerous modifications to the present invention will be apparent to those skilled in the art in view of the foregoing description. Accordingly, this description is to be construed as illustrative only and is presented for the purpose of enabling those skilled in the art to make an use the invention and to teach the best mode of carrying out the invention. The exclusive rights to all modifications which come within the scope of the appended claims are reserved.

What is claimed is:

1. A capping device for installing overcaps onto a plurality of aerosol cans moving on a manufacturing line, the capping device comprising:

a pressure plate having a cap contact surface on one side and a bearing surface on an opposite side, the contact surface being oriented to face overcaps resting on a plurality of aerosol cans moving past the pressure plate manufacturing line, the contact surface being rotatable about an axis so that an installation segment of the contact surface moves in concert with the plurality of aerosol cans;

a pressure wheel having a rotatable circumferential surface arranged to bear against a part of the pressure plate to bear the installation segment into contact with the overcaps of the plurality of aerosol cans; and a resilient support that supports and orients the pressure plate in an unbiased rotation plane generally perpendicular to the axis, and that permits the pressure plate to be reoriented to an offset rotation plane at an angle relative to the unbiased plane to bring the installation segment into abutment with the overcaps of the plurality of aerosol cans.

2. A capping device according to claim 1, wherein the pressure wheel is constructed to hold the pressure plate in the offset rotation plane orientation as the plurality of aerosol cans move past the pressure wheel.

3. A capping device according to claim 1, further comprising:

an overcap infeed segment of the contact surface spaced from the installation segment on the pressure plate, the infeed segment providing a cap infeed gap between the plurality of aerosol cans and the contact surface for resting an overcap on each of the aerosol cans prior to reaching the installation segment.

4. A capping device according to claim 1 wherein the contact surface is arranged at an angle relative to the rotation plane so that the contact surface is generally perpendicular to the axis when the pressure plate is in the offset rotation plane orientation.

5. A capping device according to claim 4, wherein the pressure plate is a rotary disc having a radially extending flange defining the contact surface and wherein the flange is so angled relative to the rotation plane.

6. A capping device according to claim 1, wherein the pressure plate is arranged to rotate about a generally vertical rotation axis.

7. A capping device according to claim 1, wherein the pressure wheel is arranged to bear against part of the plate bearing surface.

8. A capping device according to claim 1, wherein the pressure plate is a circular disc having a radially extending flange that defines a circular contact surface and a circular bearing surface.

9. A capping device according to claim 8, wherein the aerosol cans are conveyed in a partial circular path beneath at least a portion of the contact surface at a can velocity that essentially matches a rotation velocity of the pressure plate at a particular distance from the axis.

10. A capping device according to claim 9, further comprising:

a rotating star wheel assembly arranged to rotate concentrically with the disc, the star wheel assembly having a plurality of can receiving recesses in a circumferential surface adapted for guiding the aerosol cans along the path.

11. A capping device for installing overcaps onto a plurality of aerosol cans moving on manufacturing line, the capping device comprising:

a pressure plate having a cap contact surface on one side and a bearing surface on an opposite side, the contact surface being orientated to face overcaps resting on a plurality of aerosol cans moving past the pressure plate manufacturing line, the contact surface being rotatable about an axis so that an installation segment of the contact surface moves in concert with the plurality of aerosol cans;

a pressure wheel having a rotatable circumferential surface arranged to bear against a part of the pressure plate to bear the installation segment into contact with the overcaps of the plurality of aerosol cans;

the pressure plate being a circular disc having a radially extending flange that defines a circular contact surface and a circular bearing surface; and a resilient support supporting the disc, the support including a plurality of vertically oriented pins extending from a rotary shaft hub, each pin having an upper pin shoulder that limits vertical travel of the disc and a spring that bears against a portion of the disc and biases the disc upward into contact with the shoulder and permits the installation segment to be moved downward toward the plurality of aerosol cans.

12. A capping station for installing an overcap on each of the plurality aerosol cans moving along a manufacturing line, the capping station comprising:

an aerosol can infeed conveyer moving a plurality of aerosol cans to the station;

an overcap infeed adapted to initially rest an overcap on each of the aerosol cans entering the station to produce a plurality of can preassemblies;

a pressure plate having a cap contact surface on one side and a bearing surface on a opposite side, the contact surface being oriented to face the overcaps of the can preassemblies moving past the pressure plate through the station, the contact surface being rotatable about an axis so that an installation segment of the contact surface moves in concert with the can preassembly;

a pressure wheel having a rotatable circumferential surface arranged to bear against a part of the pressure plate to bear the installation segment against the overcaps of the can preassembly;

a resilient support that supports and orients the pressure plate in an unbiased rotation plane generally perpendicular to the axis, and that permits the pressure plate to be reoriented to an offset rotation plane at an angle relative to the unbiased plane to bring the installation segment into abutment with the overcaps of the can pre-assemblies.

13. A capping station according to claim 12, wherein the pressure wheel is constructed to hold the pressure plate in the offset rotation plane orientation as the can preassemblies move past the pressure wheel.

14. A capping station according to claim 12, further comprising:

an overcap infeed segment of the contact surface spaced from the installation segment on the pressure plate, the infeed segment providing a cap infeed gap between the plurality of aerosol cans and the contact surface for resting an overcap on each of the aerosol cans prior to reaching the installation segment.

15. A capping station according to claim 12, wherein the contact surface is arranged at an angle relative to the rotation plane so that the contact surface is generally perpendicular to the axis when the pressure plate is in the offset rotation plane orientation.

16. A capping station according to claim 15, wherein the pressure plate is a rotary disc having a radially extending flange defining the contact surface and wherein the flange is so angled relative to the rotation plane.

17. A capping station according to claim 12, wherein the pressure plate is arranged to rotate about a generally vertical rotation axis.

18. A capping device according to claim 12, further comprising:

a transfer wheel assembly arranged concentrically and affixed for co-rotation with the pressure plate, the transfer wheel assembly having at least one transfer star wheel with a plurality of can receiving recesses in a circumferential surface adapted for guiding the aerosol cans along the path.

19. A capping station according to claim 18, further comprising:

an infeed wheel assembly arranged to rotate about a second axis parallel to contact surface rotation axis, the infeed wheel assembly having at least one infeed star wheel with a plurality of can receiving recesses in a circumferential surface adapted for receiving aerosol cans from the infeed conveyor and delivering the aerosol cans to the transfer wheel assembly prior to reaching the installation segment of the pressure plate.

20. A capping station according to claim 18, further comprising:

a discharge wheel assembly arranged to rotate about a third axis parallel to the contact surface rotation axis, the discharge wheel assembly having at least one discharge star wheel with a plurality of can receiving recesses in a circumferential surface adapted for receiving aerosol cans with installed overcaps from the transfer wheel assembly and delivering the aerosol cans to the discharge conveyor.

21. A capping station according to claim 12, wherein the pressure plate is a circular disc having a radially extending flange that defines the contact surface and the bearing surface and is arranged to rotate about a generally vertical rotation axis.

22. A capping station according to claim 12, wherein the pressure wheel is arranged to bear against part of the plate bearing surface.

23. A capping station according to claim 22, wherein the aerosol cans are conveyed in a partial circular path beneath at least a portion of the contact surface at a can velocity that essentially matches a rotation velocity of the pressure plate at a particular distance from the axis.

24. A capping device for installing an overcap on each of the plurality aerosol cans moving along a manufacturing line, the capping station comprising:

an aerosol can infeed conveyer moving a-plurality of aerosol cans to the station;

an overcap infeed adapted to initially rest an overcap on each of the aerosol cans entering the station to produce a plurality of can preassemblies;

a pressure plate having a cap contact surface on one side and a bearing surface on a opposite side, the contact surface being oriented to face the overcaps of the can preassemblies moving past the pressure plate through the station, the contact surface being rotatable about an axis so that an installation segment of the contact surface moves in concert with the can preassembly;

a pressure wheel having a rotatable circumferential surface arranged to bear against a part of the pressure plate to bear the installation segment against the overcaps of the can preassembly;

the pressure wheel being arranged to bear against a part of the plate bearing a surface; and a resilient support that supports and orients the disc, the support including a plurality of vertically oriented pins extending from a rotary shaft hub, each pin having an upper pin shoulder that limits vertical travel of the disc and a spring that bears against a portion of the disc and biases the disc upward into contact with the shoulder and permits the installation segment to be moved downward toward the plurality of aerosol cans.

25. A capping station for installing an overcap on each of a plurality of aerosol cans moving along a manufacturing line, the capping station comprising:

an aerosol can infeed conveyor moving a plurality of aerosol cans to the station;

an overcap infeed adapted to initially rest an overcap upon each of the aerosol cans entering the station to produce a plurality of can preassemblies;

a pressure plate having a cap contact surface on one side and a barring surface on an opposite side, the contact surface being oriented to face the overcaps of the can preassemblies moving past the pressure plate through the station, the contact surface being rotatable about an axis so that an installation segment of the contact surface moves in concert with the can preassemblies;

a pressure wheel having a rotatable circumferential surface arranged to bear against a part of the pressure plate to bear the installation segment against the overcaps of the can preassemblies;

a transverse wheel assembly arranged concentrically and a fixed for co-rotation with the pressure plate, the transverse wheel assembly having at least one transverse star wheel with a plurality of can receiving recesses in a circumferential surface adapted for guiding the aerosol cans along the path;

an infeed wheel assembly arranged to rotate about a second axis parallel to the surface rotation axis, the infeed wheel assembly having at least one infeed star wheel with a plurality of can receiving recesses in a circumferential surface adapted for receiving aerosol cans from the infeed conveyor and delivering the aerosol cans from the infeed conveyor and delivering the aerosol cans to the transverse wheel assembly prior to reaching the installation segment of the pressure plate;

a cap outlet of the overcap infeed being positioned between the infeed wheel assembly and the transfer wheel assembly.

* * * * *